US006216946B1

(12) United States Patent
Cai

(10) Patent No.: US 6,216,946 B1
(45) Date of Patent: Apr. 17, 2001

(54) FOOD SCOOP WITH CONDIMENT HOLDER

(75) Inventor: Liming Cai, West Chester, PA (US)

(73) Assignee: Dopaco, Inc., Exton, PA (US)

( * ) Notice: Subject to any disclaimer, the term of this patent is extended or adjusted under 35 U.S.C. 154(b) by 0 days.

(21) Appl. No.: 09/458,013

(22) Filed: Dec. 10, 1999

(51) Int. Cl.[7] ..... B65D 3/24

(52) U.S. Cl. ..... 229/400; 220/738; 229/904; 229/906

(58) Field of Search ..... 229/400, 902, 229/904, 906; 206/216, 541; 220/737, 738

(56) References Cited

U.S. PATENT DOCUMENTS

| | | | | |
|---|---|---|---|---|
| 1,801,148 | * | 4/1931 | Gilson | 206/541 |
| 3,128,984 | * | 4/1964 | Palm | 220/737 |
| 3,640,380 | * | 2/1972 | Huffman | 229/904 |
| 4,126,261 | | 11/1978 | Cook . | |
| 4,489,879 | * | 12/1984 | Mode | 229/904 |
| 4,491,220 | * | 1/1985 | Daviss | 220/737 |
| 5,137,210 | | 8/1992 | Hibbs . | |
| 5,417,364 | | 5/1995 | Shaw . | |
| 5,476,215 | * | 12/1995 | Baroud | 229/902 |
| 5,540,333 | | 7/1996 | Gonzalez et al. . | |
| 5,626,283 | | 5/1997 | Mellon . | |
| 5,720,429 | | 2/1998 | Cordle . | |
| 5,775,570 | * | 7/1998 | Kim | 229/904 |
| 5,799,794 | * | 9/1998 | Whitnell | 229/904 |
| 5,842,631 | | 12/1998 | Berger . | |
| 5,875,957 | | 3/1999 | Yocum . | |
| 5,979,747 | * | 11/1999 | Gnadt et al. | 229/904 |

* cited by examiner

*Primary Examiner*—Gary E. Elkins
(74) *Attorney, Agent, or Firm*—Dennison, Scheiner, Schultz & Wakeman

(57) ABSTRACT

A food scoop having a holder for a condiment receptacle is disclosed. The holder and food scoop are formed from a unitary blank of material and the holder forms a continuation of the side wall of the scoop to allow for stacking and storage until the holder is deployed for use. After deployment, the holder securely retains a condiment receptacle and resists the forces applied to the receptacle during use. A blank for forming the food scoop and holder is also disclosed.

17 Claims, 5 Drawing Sheets

FOOD SCOOP WITH CONDIMENT HOLDER

The present application is directed to a food scoop, and more specifically, to a food scoop with a holder for a condiment receptacle.

BACKGROUND OF THE INVENTION

French fries, onion rings, popcorn shrimp, and other finger-foods are often served from small paperboard containers. These containers may be pouch-shaped, like those used for french fries in many fast-food establishments, or shaped like a cup. Because such containers are often used to scoop individual servings from a product batch, they are sometimes referred to as "food scoops."

The food products described above are often dipped into sauces or condiments, such as ketchup, mustard, or vinegar before they are eaten. Many food service establishments provide bulk containers of these condiments and small paper or plastic cups into which they can be dispensed. Alternately, the condiments may come prepackaged in a sealed container.

If the food product is consumed by a person while seated at a table, the condiment containers can be placed on the table. If a person wishes to walk with the container, on a boardwalk or at an amusement park, for example, or to eat the food product while driving a vehicle, the use of a condiment becomes more difficult. Both the condiment cup and food scoop must be held in one hand while the other hand grasps an item of food and dips it in the condiment. This method makes activities such as driving very difficult and possibly dangerous. It is also possible to dispense a condiment directly onto the food products in the food scoop, but this can be messy and often results in an uneven distribution of condiment. When walking or driving, therefore, persons sometimes forego the use of sauces or condiments altogether, or have to endure the inconvenience of eating sticky, condiment-covered food products with their fingers.

Various attempts have been made to address this problem by providing food containers with compartments for holding a condiment. For example, U.S. Pat. No. 5,875,957 to Yocum, owned by the assignee of the present invention, and U.S. Pat. No. 5,720,429 to Cordle show food scoops having interior pockets that can be filled with condiments. However, pockets such as these can be inadvertently squeezed, leading to condiment spills either into the food scoop or onto the user. These pockets also make containers more difficult to assemble and more costly to produce. U.S. Pat. No. 5,417,364 to Shaw and U.S. Pat. No. 5,842,631 to Berger show complex folding shelves formed separately from a food scoop and glued or otherwise attached to the food scoops for supporting a condiment receptacle. Such attachments also add to the cost of food scoops and make them more difficult to assemble. In addition, they do not securely retain a condiment receptacle when the food scoop is carried by a user or balanced in a moving vehicle.

It would therefore be desirable to provide a condiment holder that is integrally formed with a food scoop, that is capable of securely retaining a condiment receptacle even when the food scoop is carried or jarred, and that can be produced at substantially the same cost as existing food scoops that lack this inventive feature.

SUMMARY OF THE INVENTION

The present invention addresses these and other problems by providing a food scoop having a holder for a condiment receptacle that extends outwardly from a side wall thereof and that is designed to securely retain a condiment receptacle even when the food scoop is shaken or jarred. In a first aspect, the invention comprises a holder that is cut from the side wall of the container. In a storage or non-use position, the holder forms an extension of the side wall of the food scoop and allows the scoop to be produced and stacked in the same manner as prior art scoops. In the deployed or use position, the holder extends away from the side wall to form a support with an opening for engaging the side wall or walls of a sauce receptacle and, optionally, a bottom panel for supporting the bottom of the receptacle.

The present condiment holder can be incorporated into the design of most existing food scoops. Significantly, in many food scoop designs, the condiment holder is formed from material that is currently discarded as scrap. Thus the material costs of a food scoop incorporating the present invention are the same as the costs of prior art scoops. The additional cutting steps required to form the holder during the manufacturing process do not add appreciably to the product cost.

In another aspect of the invention, the food scoop with condiment holder is formed from a unitary blank of foldable material, such as paperboard. This allows the product to be produced using the same methods used for traditional food scoops. Because the holder forms an extension of the food scoop side wall when it is not deployed, the food scoops can be erected in a normal manner, generally using the same equipment or methods used in the past. The condiment receptacle holder does not need to be deployed until after the scoop is filled with food. This step may frequently be carried out by the purchaser of the food product and thus requires no extra work on the part of a vendor. Therefore the present design provides added benefits without increasing the cost of manufacture or ease of assembly as compared to prior art food scoops that lack a condiment holder.

In yet another aspect of the invention, the condiment holder is cut from the side wall of the container so that the resulting opening in the side wall is narrower that the width of the condiment receptacle. This substantially prevents the receptacle from being pressed into the interior of the food scoop during use. In addition, because of the tight fit between the receptacle and the opening in the condiment holder top panel, downward pressure on the receptacle causes the receptacle to pivot with the flap about the fold line that connects the flap to the side wall. Because the opening in the side wall is narrower than the receptacle, the side wall substantially halts this downward pivoting after the receptacle has moved only a small distance. Therefore, downward pressure on the receptacle, such as may occur when a user dips a food item into the condiment, does not cause the condiment to spill, but rather causes the container to be held even more securely by the holder.

It is therefore a principal object of the present invention to provide a receptacle holder for a container.

It is another object of the invention to provide a food scoop having an integral holder for a condiment receptacle.

It is a further object of the invention to provide a food scoop having a condiment receptacle holder that securely retains a condiment receptacle during transport and use.

It is yet another object of the invention to provide a unitary blank for forming a food scoop having a receptacle holder.

It is yet a further object of the present invention to provide a receptacle holder that can be readily incorporated into the design of existing food scoops.

It is still another object of the present invention to provide a receptacle holder for a food scoop that engages the receptacle more securely when downward pressure is exerted against the receptacle.

It is still a further object of the present invention to provide a food scoop having a condiment holder shiftable between a first configuration wherein the scoop can be stacked and stored and a second configuration wherein the holder extends outwardly from the side wall of the holder.

BRIEF DESCRIPTION OF THE DRAWINGS

These and other objects of the invention will be better understood after a reading and understanding of the following detailed description of several preferred embodiments and drawings of which.

DETAILED DESCRIPTION OF THE PREFERRED EMBODIMENTS

Figure 1:
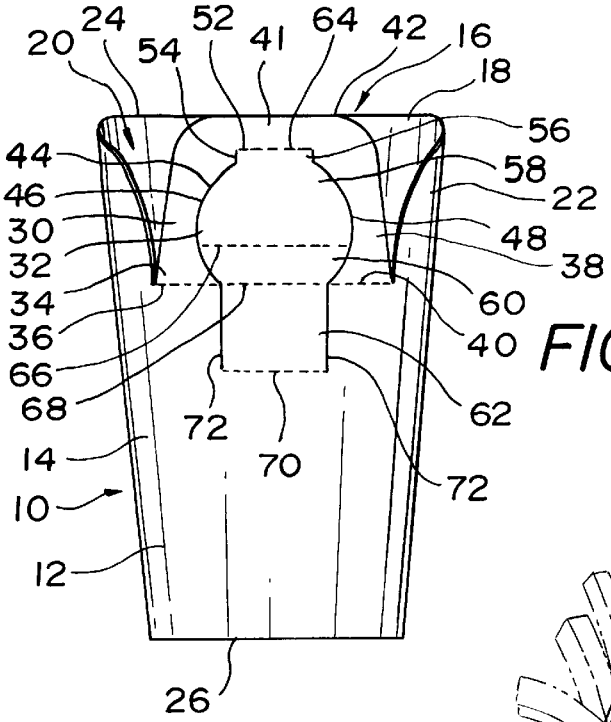
FIG. 1 is a front elevation view of a food scoop according to the present invention showing a receptacle holder in a storage position.

Referring now to the drawings, wherein the showings are for purposes of illustrating several preferred embodiments of the invention only and not for the purpose of limiting same, FIG. 1 shows a food scoop designated generally by the numeral 10 having a side wall 12 divided into a side wall body portion 14 and a holder portion 16. Side wall 12 includes an inner surface 18 defining a scoop interior 20 and an outer surface 22, and further includes an upper edge 24 and a lower edge 26. A bottom wall 28 is connected to lower edge 26 of side wall 12 in a conventional manner, or alternately, may be integrally formed with the container side wall.

The food scoop of the present invention is intended to be used with the opening formed by upper edge 24 facing generally upwardly, although in normal use the it will often be tilted somewhat in one direction or another to allow easier access to its contents. In the present description, the food scoop will be described as resting in this typical orientation with bottom 28 on a level support surface (not shown).

In the non-deployed configuration shown in FIG. 1, holder 16 includes an outer portion 30 and an inner portion 32. Outer portion 30 is generally arcuate and includes a first end 34 connected to body portion 14 at a first fold line 36, a second end 38 connected to the body portion at a second fold line 40, and a central portion 41. Outer portion 30 further includes an outer periphery 42 and an inner periphery 44 comprising first and second opposed arcuate sections 46, 48 and a notch portion 50 having a linear section 52 set off from the arcuate sections by notch end walls 54.

Inner portion 32 is tongue shaped, partially surrounded by outer portion 30, and divided into four sections, from top to bottom, a first section 56, second section 58, third section 60 and fourth section 62. Inner portion 32 is cut from outer portion 30 and side wall 14, and therefore is defined in part by the shape of the outer portion material surrounding it when the holder is in its storage position.

First section 56 is connected to central portion 41 of outer portion 30 along a third fold line 64 and comprises the portion of the inner portion located between notch end walls 54. Second section 58 is bounded by first section 56, a fourth fold line 66, which lies parallel to and between third fold line 64 and first fold line 36, and the parts of arcuate sections 46 and 48 that lie between the third and fourth fold lines. Third section 60 is bounded by fourth fold line 66, an imaginary line 68 (not a fold line) connecting first fold line 36 to second fold line 40, and the parts of arcuate sections 46 and 48 that lie between fourth fold line 66 and the imaginary line. Fourth section 62 extends between the imaginary line and a fifth fold line 70 located on the opposite side of the imaginary line from the fourth fold line and bounded by parallel side edges 72. The distance between arcuate sections 46 and 48 at their greatest separation is greater than the distance between side edges 72.

Figure 2:
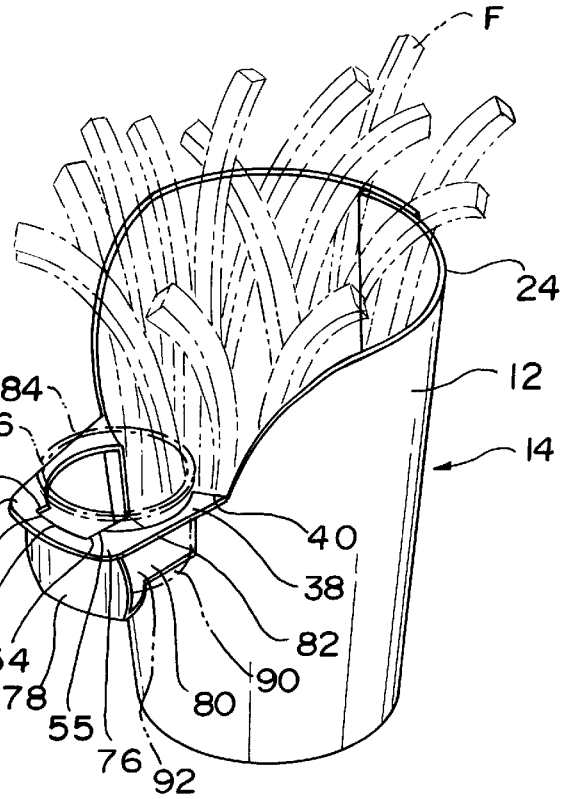
FIG. 2 is a perspective view of the food scoop of FIG. 1 showing a receptacle holder in the deployed position holding a condiment receptacle and a food product in the food scoop.

To deploy the holder, pressure is exerted against the inner holder portion 32 to move this inner portion away from the food scoop interior. At the same time, outer portion 30 is pivoted about fold lines 36 and 40 until it is roughly perpendicular to side wall 12. This movement separates outer portion 30 from inner portion 32 except where they remain attached at third fold line 64. This deployment results in the formation of a holder top panel 76 coextensive with holder outer portion 30, a holder side panel 78 comprising first section 56 and second section 58, and a holder bottom panel 80 comprising third section 60 and fourth section 62. Holder top panel 76 includes an opening 82 partially defined by arcuate sections 46 and 48 and the area of body portion 12 in the vicinity of the holder portion 16. The holder can be deployed either before or after food products F, shown as french fries in FIG. 2, are placed into the interior of the food scoop.

Condiment receptacles are available in a number of standard shapes and sizes, and the shape of opening 82 is chosen to be compatible with a particular receptacle. For example, in the preferred embodiment, a round receptacle 84, which may be formed of paper or plastic, for example, is used. Receptacle 84 includes a top opening 86 surrounded by a lip 88, a bottom wall 90 slightly smaller in diameter than the diameter of the top opening, and a side wall 92 extending between the lip and the bottom wall, the side wall being somewhat tapered toward bottom wall 90 due to the size difference between the top and bottom of the cup. Cup 84 is filled with a condiment and inserted into opening 82 in the holder and pressed downwardly so that the arcuate portions 46 and 48 of the holder securely engage the side wall 92 and bottom wall 90 comes into contact with holder bottom panel 80. Cups having a shorter side wall may be supported entirely by opening 82 if they are not tall enough to reach the bottom panel. Alternately, cups that have cylindrical side walls and no top lips for engaging the top panel may be supported primarily by the bottom wall and steadied by the opening in the top panel.

Food items can be dipped into the condiment in cup 84 and consumed. If the food scoop is placed on a table or in a cup holder, such as in an automobile, a user can remove food from the scoop, dip it in the condiment, and consume it using one hand. If the food scoop is carried in one hand, the user can dip food items in the condiment using his other hand.

The relationship between the diameter of opening 82 in top panel 76, the diameter of receptacle 84, and the distance between side edges 72 of the fourth section of inner portion 32 contributes significantly to the advantages of the present invention. Specifically, the distance between side edges 72 is selected to be less than the diameter or width of the receptacle to be retained in the holder. This prevents the receptacle from sliding into the interior of the food scoop, even after all or most of the food product F has been removed therefrom.

In addition, because arcuate sections 46 and 48 conform closely to side wall 92 of the cup, the cup and the top panel section tend to move in unison when a force is applied against one or the other of these elements. In use, therefore, a person may apply a downward force against cup 84 when dipping a food item into the receptacle. This downward force causes cup 84 and top panel 76 to begin to pivot about imaginary line 68. However, because the distance between side edges 72 is less than the width of the cup, the cup comes into contact with side edges 72 and the downward movement of the cup and holder combination is halted. This arrangement allows the relatively flexible material from which the food scoop and holder are formed to support the weight of the condiment and cup and resist deformation during normal use.

Likewise, a cup 84 can be inserted into opening 86 when empty. After holder portion 16 is deployed, the slight elasticity of the paperboard causes the holder to return a small distance toward its storage position. The weight of a full condiment cup is more than enough to overcome this elasticity. However, the weight of an empty cup may be insufficient to do so. Again, because the width of cup is greater than the distance separating side edges 72, the cup side wall 92 contacts side edges 72 when holder top wall flexes upwardly. Moreover, the bottom of cup side edge 92 comes into contact with holder side panel 78 when the cup pivots upwardly, limiting the upward movement of top panel 76. This allows a user, if he desires, to place an empty receptacle in the holder, take the food scoop to a condiment dispenser, and fill the receptacle while it held in the holder.

Corners 55 are formed where notched end walls 54 meet arcuate sections 46, 48. These corners provide areas of point contact between the holder and receptacle to better secure the receptacle and to minimize rotation of the receptacle in the holder.

Figure 4:
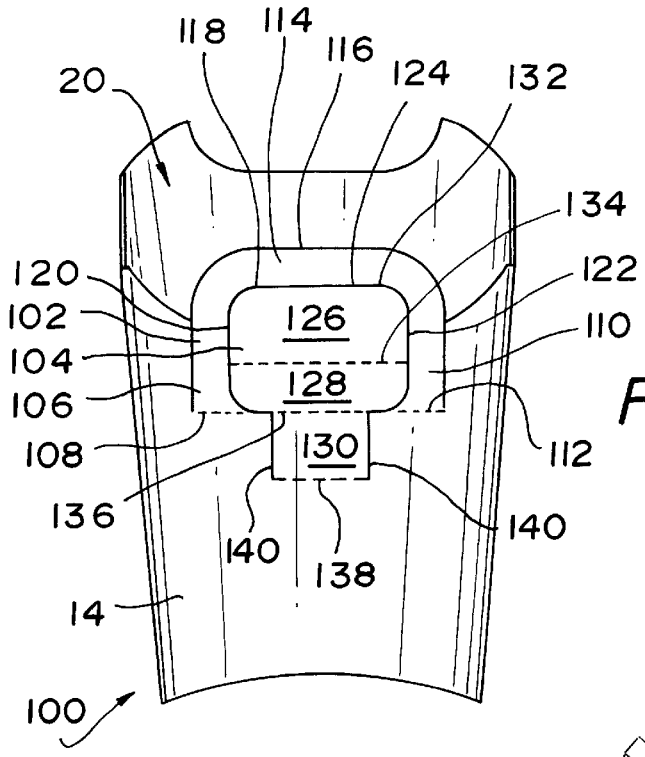
FIG. 4 a front elevation view of a second embodiment of a food scoop according to the present invention.
Figure 5:
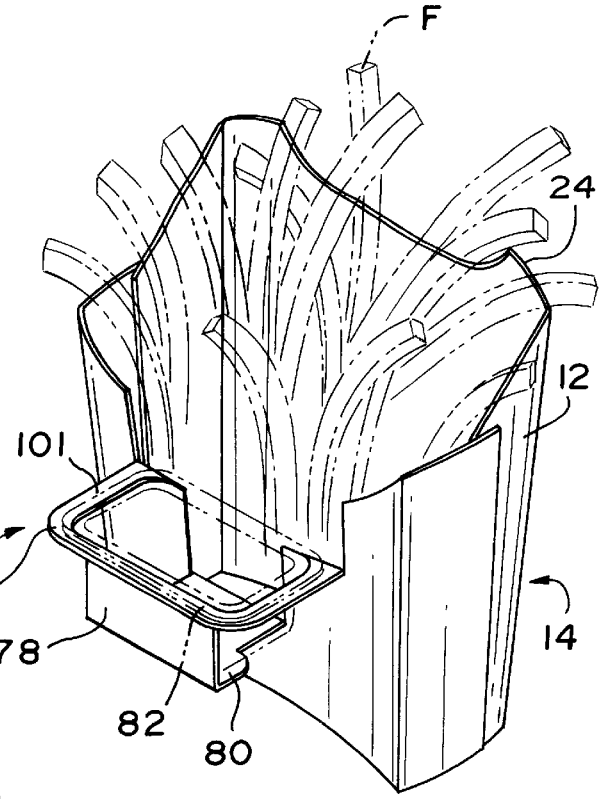
FIG. 5 is a perspective view of the food scoop of FIG. 4 showing a receptacle holder in the deployed position holding a condiment receptacle and a food product in the food scoop.
Figure 6:
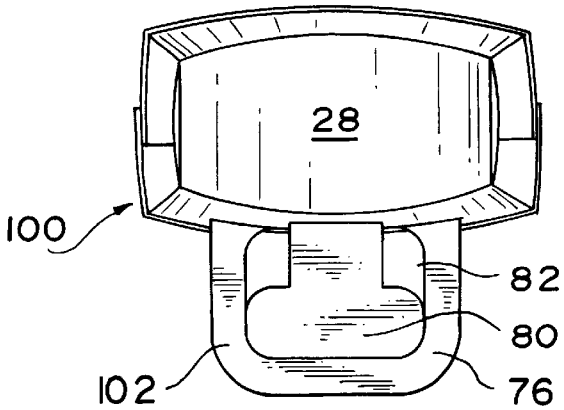
FIG. 6 is a top plan view of the food scoop of FIG. 4 showing the receptacle holder in the deployed position.

FIGS. 4–6 show a second embodiment of the subject invention wherein elements common to the first embodiment are identified with the same reference numerals. In the non-deployed configuration shown in FIG. 4, holder 100 includes an outer portion 102 and an inner portion 104. Outer portion 102 is generally arcuate and includes a first end 106 connected to body portion 14 at a first fold line 108, a second end 110 connected to the body portion at a second fold line 112, and a central portion 114. Outer portion 102 further includes an outer periphery 116 and an inner periphery 118 comprising first and second opposed parallel sections 120, 122, joined by a linear section 124.

Inner portion 104 is tongue shaped, partially surrounded by outer portion 102, and divided into three sections, from top to bottom, a first section 126, second section 128, and a third section 130. Inner portion 104 is cut from outer portion 102 and side wall 14, and therefore is defined in part by the shape of the outer portion material surrounding it when the holder is in its storage position.

First section 126 is connected to central portion 114 of outer portion 102 along a third fold line 132 and comprises the portion of the inner portion between linear section 124, parallel sections 120, 122 and a fourth fold line 134 parallel to linear section 124. Second section 128 is bounded by fourth fold line 134, parallel sections 120, 122, and a line 136 connecting first fold line 108 and second fold line 112. Third section 130 is bounded by line 136, a fifth fold line 138 located on the opposite side of the line 136 from the fourth fold line and bounded by parallel side edges 140 extending between the first and second fold lines and fifth fold line 138. The distance between parallel sections 120, 122 is greater than the distance between side edges 140.

In this embodiment, the opening 82 in holder top panel 76 is shaped to receive a receptacle 101 having a rectangular cross section. The food scoop itself also has a different shape than the scoop of the first embodiment, demonstrating that the present invention can be practiced with a variety of different food scoops. Both scoops and holders function in substantially the same manner.

Figure 3:
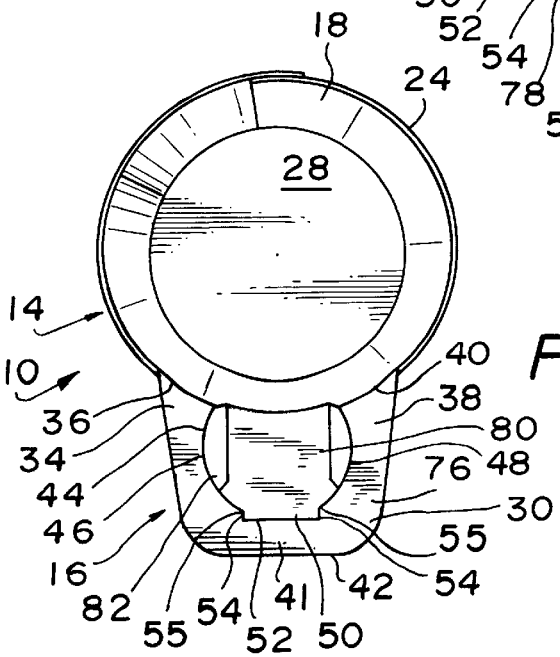
FIG. 3 is a top plan view of the food scoop of FIG. 1 showing the receptacle holder in the deployed position.
Figure 7:
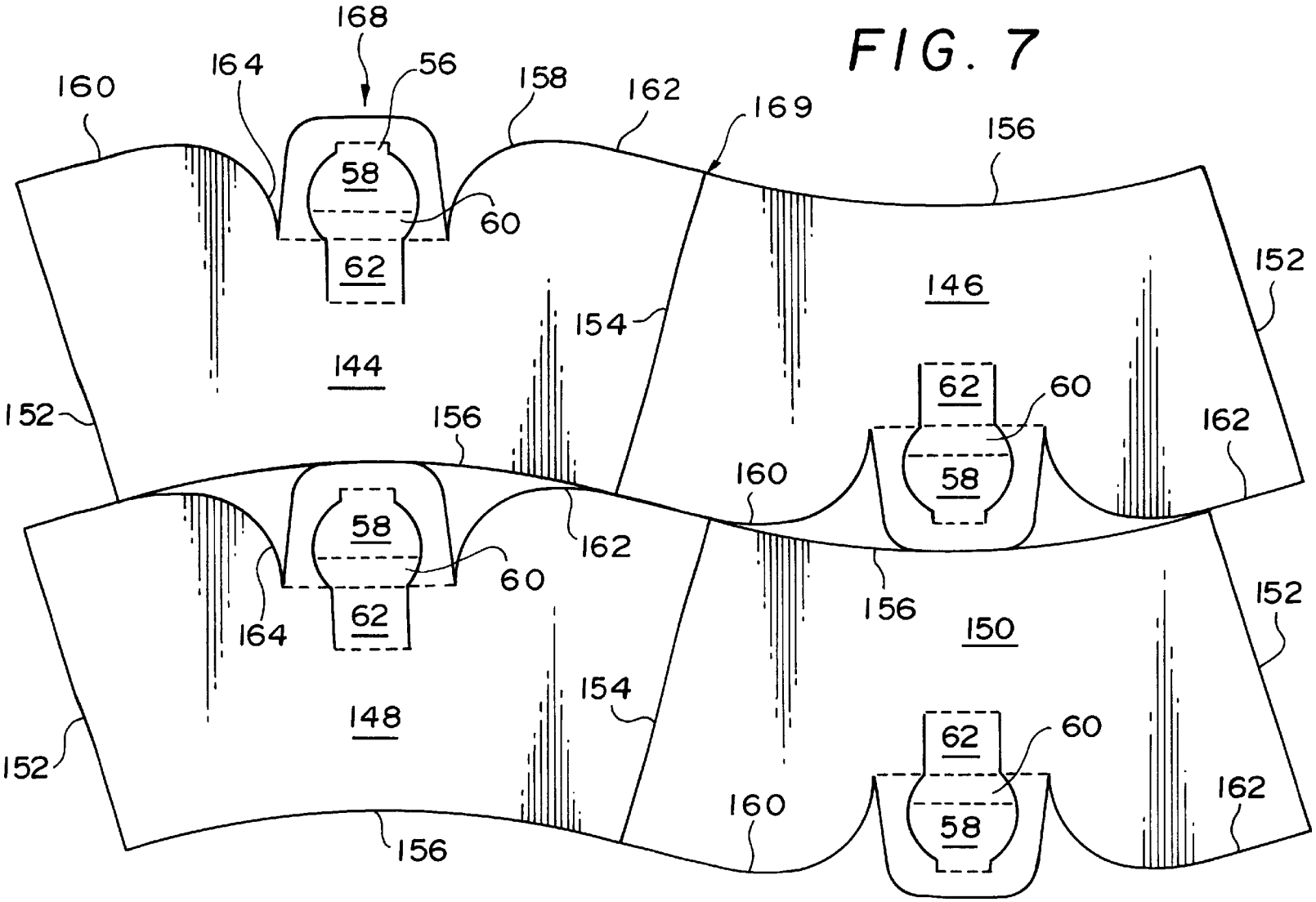
FIG. 7 is a plan view of a plurality of interconnected blanks used to form the food scoop shown in FIG. 1.

FIG. 7 shows four blanks 144, 146, 148, and 150 that can be formed into the food scoop and holder shown in FIGS. 1–3. The blanks are identical, and each includes a first side edge 152, a second side edge 154, a curved bottom edge 156 and a top edge 158 having first and second end portions 160, 162 and a recessed central portion 164 from which a tongue 168 protrudes. As will be appreciated from FIG. 7, the blanks fit together tightly and a number of blanks can be cut from a sheet of material with little waste. For example, blanks 144, 146 are separated by a score line 169, which single score line forms second side edge 154 of blank 144 and first side edge 152 of blank 146. Furthermore, the bottoms ends of first and second side edges 152, 154 of blank 144 are connected to the first and second end portions 160, 162 of top edge 158 of third blank 148 before the blanks are separated, and tongue 168 of blank 148 is connected to the central portion of bottom edge 156 of first blank 146.

Blanks for forming food scoops without a receptacle holder are substantially similar to those shown in FIG. 7 but would not include tongue 168. The material where tongue 168 is formed is often discarded as scrap. The invention thus reduces the amount of scrap produced and provides a novel food scoop having the same materials cost as prior art scoops.

Figure 8:
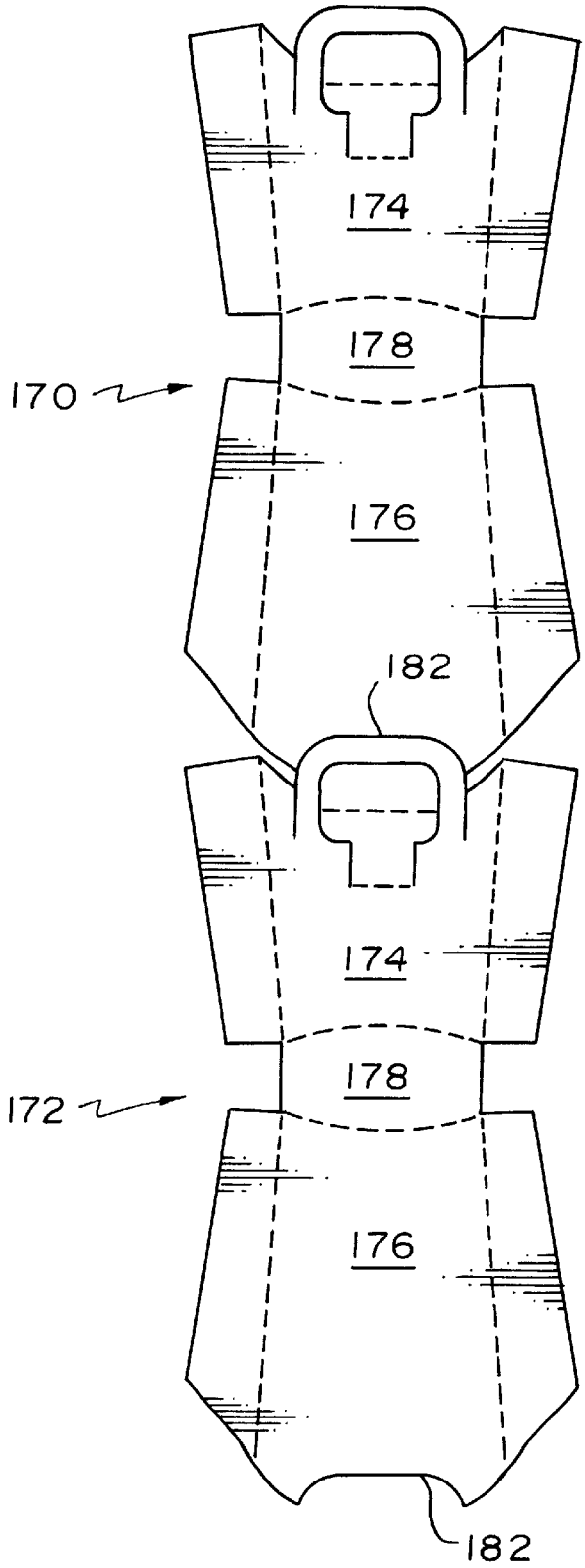
FIG. 8 is a plan view of two interconnected blanks used to form the food scoop shown in FIG. 4.

FIG. 8 shows two blanks 170, 172 for forming the food scoop shown in FIGS. 4–6. Each blank includes a front panel 174, a rear panel 176, and a bottom panel 178 connecting the front and rear panels. A tongue 180 extends from the side of front panel 174 opposite rear panel 176. A notch 182 is provided in the lower portion of the rear panel 176 to accommodate the tongues 180 of an adjacent blank. This allows the blanks to be closely spaced on a sheet of material to minimize waste. The notch 182 can be omitted in situations where a notch-less food scoop is desired.

Figure 9:
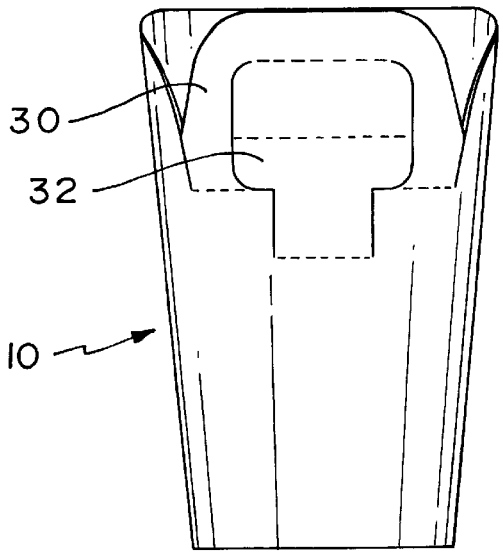
FIG. 9 is a front elevation view of a third embodiment of a food scoop according to the present invention; and, FIG. 10 is a front elevation view of a fourth embodiment of a food scoop according to the present invention.

FIG. 9 shows a third embodiment of the invention wherein a cup-shaped food scoop is provided with a holder for a rectangular receptacle.

Figure 10:
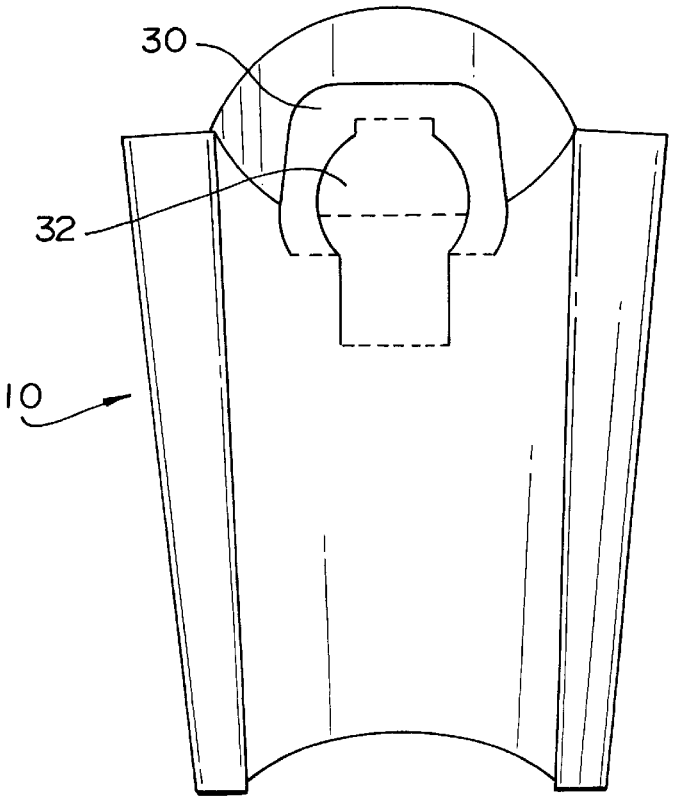

FIG. 10 shows a fourth embodiment of the invention wherein a pouch-shaped food scoop is provided with a holder for a receptacle having a circular cross section.

The subject invention has been described herein in terms of several preferred embodiments; however, it will be appreciated that additions and modifications to the invention will become evident to those skilled in the art upon a reading and understanding of the foregoing description together with the attached drawings. For example, the receptacle holders are not limited to use with receptacles having round and rectangular cross sections—these are merely the shapes most commonly used today. Furthermore, the shape of the food scoop used can be varied without departing from the scope of this invention. It is intended that all such obvious modifications and additions be included within the scope of this application to the extent that they are described by the several claims appended hereto.

I claim:

1. A food container having at least one side wall defining an interior, said side wall comprising a first portion extending away from said interior and including an opening for supportably engaging at least one side wall of a sauce receptacle, wherein said opening is cut out from said container side wall and includes first and second opposed regions for engaging opposed side wall sections of a receptacle and wherein said first portion includes a bottom panel for supportably engaging the receptacle.

2. A food container according to claim 1 wherein said first portion holds the receptacle against said side wall.

3. A food container according to claim 1 wherein said first and second opposed portions are arcuate.

4. A food container having at least one side wall defining an interior, said side wall comprising a first portion extending away from said interior and including an opening for supportably engaging at least one side wall of a sauce receptacle, said opening being cut out from said container side wall and including first and second opposed arcuate portions extending outwardly from said side wall for engaging opposed side wall sections of a receptacle, said opening further including a linear portion separating said arcuate portions.

5. A food container according to claim 4 wherein said linear portion is offset from said arcuate portions.

6. An upwardly opening food container having at least one side wall defining an interior, said side wall comprising a flap having a first portion connected thereto at a fold line and a second portion, said flap being foldable between a first position with said first portion generally parallel to said side wall and a second position with said first portion generally perpendicular to said side wall said first portion including an opening for retaining a sauce receptacle and said second portion defining a support for the sauce receptacle.

7. A food container according to claim 6 wherein said side wall is planar.

8. A food container according to claim 6 wherein said opening includes first and second opposed portions for engaging opposed side wall sections of a receptacle.

9. A food container according to claim 8 wherein said flap includes a bottom panel for supportably engaging the receptacle.

10. A food container according to claim 9 wherein said first and second opposed portions are arcuate and extend outwardly from said side wall and said opening includes a linear portion separating said arcuate portions.

11. A food container according to claim 10 wherein said linear portion is spaced apart from said arcuate portions.

12. A food container according to claim 9 wherein said flap comprises a cut-out section of said side wall having a width less than the greatest distance separating said opposed portions.

13. The food container of claim 6 wherein said second portion is cut partially from said first portion.

14. A unitary blank for forming a food container comprising a body portion and a tongue portion partially separated from said body portion by score lines, said tongue portion having an arch-shaped outer portion having first and second ends connected to said body portion at first and second fold lines, and an inner portion partially surrounded by said outer portion and having a first end hingedly connected to said body portion at a third fold line, a second end hingedly connected to said outer portion along a fourth fold line between said first and second ends of said arch-shaped portion, and a fifth fold line between said first and second ends of said inner portion generally parallel to said third fold line.

15. A unitary blank according to claim 14 wherein the portion of said tongue portion surrounded by said outer portion is wider than the portion of said tongue not surrounded by said outer portion.

16. A unitary blank according to claim 14 having a top edge bounded by a first curve having a central portion and first and second end portions, and a bottom edge bounded by a second curve having a central portion and first and second end portions, wherein the radius of curvature of said first curve central portion is equal to the radius of curvature of said second curve central portion.

17. A unitary blank according to claim 14 further including a notch in said body portion for accommodating at least part of the tongue portion of an adjacent blank, whereby, multiple blanks can be arranged in close proximity on a sheet of blank material.

* * * * *